US012446742B2

(12) United States Patent
Roschi

(10) Patent No.: US 12,446,742 B2
(45) Date of Patent: Oct. 21, 2025

(54) MOTORIZED SUCTION HEAD

(71) Applicant: NEW ERMES EUROPE S.R.L., Crosio della Valle (IT)

(72) Inventor: Riccardo Roschi, Crosio della Valle (IT)

(73) Assignee: NEW ERMES EUROPE S.R.L., Crosio Della Valle (IT)

( * ) Notice: Subject to any disclaimer, the term of this patent is extended or adjusted under 35 U.S.C. 154(b) by 356 days.

(21) Appl. No.: 18/259,022

(22) PCT Filed: Dec. 17, 2021

(86) PCT No.: PCT/EP2021/086620

§ 371 (c)(1),
(2) Date: Jun. 22, 2023

(87) PCT Pub. No.: WO2022/136185

PCT Pub. Date: Jun. 30, 2022

(65) Prior Publication Data

US 2024/0298853 A1 Sep. 12, 2024

(30) Foreign Application Priority Data

Dec. 23, 2020 (IT) ..... 102020000032069

(51) Int. Cl.
*A47L 9/04* (2006.01)
*A47L 9/28* (2006.01)

(52) U.S. Cl.
CPC ..... *A47L 9/0411* (2013.01); *A47L 9/0477* (2013.01); *A47L 9/2831* (2013.01); *A47L 9/2847* (2013.01); *A47L 9/2857* (2013.01); *A47L 9/2889* (2013.01)

(58) Field of Classification Search
CPC .... A47L 9/0411; A47L 9/0477; A47L 9/2831; A47L 9/2847; A47L 9/2857; A47L 9/2889
See application file for complete search history.

(56) References Cited

U.S. PATENT DOCUMENTS 4,245,370 A * 1/1981 Baker ..... H02H 7/093 361/23
4,370,690 A * 1/1983 Baker ..... H02H 7/093 361/23

(Continued)

FOREIGN PATENT DOCUMENTS

CN 119908613 A * 5/2025 ..... A47L 9/0411
DE 4427639 A1 * 6/1995 ..... A47L 9/2842

(Continued)

OTHER PUBLICATIONS

International Search Report for PCT/EP2021/086620 dated Apr. 12, 2022, 4 pages.

(Continued)

*Primary Examiner* — Marc Carlson
(74) *Attorney, Agent, or Firm* — NIXON & VANDERHYE P.C.

(57) ABSTRACT

A motorized suction head comprising a roller is provided, the roller being rotatable and being configured to rub the surface to be cleaned, an electric motor and a transmission for connecting the roller to the electric motor so as to rotate the roller, an on/off switch for starting and stopping the rotation of the motor, wherein the suction head further comprises a speed selector for selecting one of a plurality of rotation speeds of the electric motor.

13 Claims, 10 Drawing Sheets

(56) References Cited

U.S. PATENT DOCUMENTS

| | | | | |
|---|---|---|---|---|
| 4,611,365 | A * | 9/1986 | Komatsu | A47L 9/2842 15/377 |
| 5,449,988 | A * | 9/1995 | Gurstein | A47L 9/2805 318/482 |
| 5,875,517 | A * | 3/1999 | Fust | A47L 9/0411 15/420 |
| 7,013,521 | B2 * | 3/2006 | Grey | A47L 11/33 15/377 |
| D599,065 | S | 8/2009 | Roschi | |
| 7,757,345 | B2 | 7/2010 | Roschi | |
| 7,797,793 | B2 | 9/2010 | Roschi | |
| D807,603 | S | 1/2018 | Roschi | |
| 10,238,254 | B2 | 3/2019 | Roschi | |
| D900,420 | S | 10/2020 | Roschi | |
| D922,014 | S | 6/2021 | Roschi | |
| 11,224,319 | B2 | 1/2022 | Roschi | |
| D953,673 | S | 5/2022 | Roschi | |
| 11,564,544 | B2 | 1/2023 | Roschi | |
| 12,365,661 | B2 * | 7/2025 | Baggott | C07D 307/80 |
| 2004/0135537 | A1 * | 7/2004 | Conner | A47L 9/2857 15/340.2 |
| 2007/0266519 | A1 * | 11/2007 | Kostreba | A47L 7/0009 15/321 |
| 2017/0280956 | A1 | 10/2017 | Roschi | |
| 2017/0319026 | A1 | 11/2017 | Roschi | |
| 2019/0174983 | A1 | 6/2019 | Roschi | |

FOREIGN PATENT DOCUMENTS

| | | | | |
|---|---|---|---|---|
| DE | 102016105439 | A1 * | 9/2017 | A47L 9/2831 |
| DE | 102019126229 | A1 * | 4/2021 | A47L 9/2831 |
| EP | 0136357 | A1 * | 4/1985 | H02P 25/14 |
| EP | 0285801 | A1 * | 10/1988 | A47L 9/2842 |
| EP | 1500365 | A2 * | 1/2005 | A47L 9/2847 |
| EP | 1764020 | A1 * | 3/2007 | A47L 9/2842 |
| EP | 2245974 | A2 * | 11/2010 | A47L 9/2831 |
| EP | 3588732 | A1 * | 1/2020 | A47L 9/322 |
| GB | 2569311 | A * | 6/2019 | A47L 9/0613 |
| JP | 2003325397 | A * | 11/2003 | A47L 5/30 |
| WO | WO-9415519 | A1 * | 7/1994 | A47L 9/2852 |
| WO | WO-2017187361 | A2 * | 11/2017 | A47L 11/4069 |

OTHER PUBLICATIONS

Written Opinion of the ISA for PCT/EP2021/086620 dated Apr. 12, 2022, 5 pages.

U.S. Appl. No. 18/479,577, filed Oct. 2, 2023, "Battery Holder for a Battery-Operated Power Tool or for a Vacuum-Cleaner Brush".

U.S. Appl. No. 18/549,535, filed Sep. 27, 2023 "Motorized Suction Head With Steam Dispensing Device".

* cited by examiner

MOTORIZED SUCTION HEAD

This application is the U.S. national phase of International Application No. PCT/EP2021/086620 filed Dec. 17, 2021 which designated the U.S. and claims priority to IT Patent Application No. 102020000032069 filed Dec. 23, 2020, the entire contents of each of which are hereby incorporated by reference.

The present invention relates to a suction head to be fitted to an electric household appliance for performing cleaning by means of suction, such as a vacuum cleaner, an electric broom, a vacuum cleaner drum or a robotic vacuum cleaner, for sucking up dust and/or fluids and/or dirt from a surface. In particular, the present invention relates to a motorized suction head.

As is known, a vacuum cleaner, an electric broom or a similar electric household appliance for performing cleaning by means of suction comprises a suction head for sucking up dust, debris or fluids from a surface. In the sector of electric household appliances, a suction head is generally referred to by the term "brush". For the purpose of the present description, therefore, the terms "suction head" and "brush" are considered to be equivalent. Again for the purpose of the present invention, the term "vacuum cleaner" will be used with a broad meaning so as to include all those apparatus, for professional or domestic use, which perform cleaning by means of suction. Therefore, the term "vacuum cleaner" will comprise a vacuum cleaner, a pull-along (cylinder) vacuum cleaner, an electric broom, a so-called vacuum cleaner drum, a robotic vacuum cleaner, a centralized suction system for domestic or industrial use and an apparatus with a combined steam/detergent suction and delivery action.

Basically a known suction head comprises a base plate shaped so as to have at least one base plate channel open towards a surface to be vacuumed, a suction channel which, during use, is integral with the base plate and is in fluid communication with the base plate channel and optionally a covering body which can be connected to the base plate/suction channel assembly. The other end of the suction channel communicates with a suction pipe usually via a rotatable joint. Also known are suction heads in which the suction channel, during use, is integral with the covering body.

Vacuum cleaner brushes include motorized brushes (also called "active brushes") and non-motorized brushes (also called "passive brushes"). Motorized brushes are provided with a rotating roller. Rotation of the roller has the function of removing the dirt from the floors and/or carpets and facilitating suction thereof by the suction body of the vacuum cleaner.

In particular motorized brushes with a mains-powered electric motor which rotationally drives the roller are known.

US 2007/266519 A1 discloses a battery powered cleaning attachment.

DESCRIPTION OF THE INVENTION

The Applicant has examined the known motorized brushes and has noted that the known motorized brushes are such that the roller is rotated at a substantially constant speed.

The substantially constant speed of the roller is advantageous since the rubbing force with which the dirt is removed from the surface is substantially constant and predictable.

However, the Applicant has considered that there are various situations where it would be preferable to have available a rotation speed different from the constant speed which is pre-set by the manufacturer.

For example, it may be desirable to be able to change the rotation speed depending on the type of surface to be cleaned: a hard marble surface could be vigorously cleaned with a roller rotating at a faster speed than that used for a costly carpet which may already be worn from use over time.

By way of a further example, it could be desirable to be able to change the speed of rotation depending on the quantity (and/or type) of dirt on the ground. A very dirty floor requires a more energetic action and therefore a higher speed of the roller compared to a less dirty floor.

Obviously, all the aforementioned situations may arise in a non-predictable and non-programmable manner, even during a working session. For example, when cleaning an apartment, there could be hard (stone or ceramic) surfaces, areas covered with rugs or carpets, and terraces or balconies which are particularly dirty.

The Applicant has considered the known brushes and the aforementioned working (and other) requirements. According to the Applicant, the aforementioned objects may be achieved with a motorized brush which has a roller with a variable speed of rotation. Preferably, the speed may be manually varied by the user.

In the case of a battery-powered motorized brush, the possibility of varying the speed of rotation could also be advantageous for prolonging the working time, namely for allowing the vacuum cleaner (with rotating roller) to work for a longer period of time.

According to a first aspect, a motorized brush comprising a roller is provided, the roller being rotatable and being configured to rub the surface to be cleaned, an electric motor and a transmission for connecting the roller to the electric motor so as to rotate the roller, an on/off switch for starting and stopping the rotation of the motor, wherein the suction head also comprises a speed selector for selecting one of a plurality of rotation speeds of the electric motor, wherein the suction head further comprises an electronic board programmed to provide a rising power ramp when the electric motor is turned on and/or a falling power ramp when the electric motor is turned off.

According to embodiments, the selector is a manual selector.

According to embodiments, the selector comprises a pushbutton.

According to embodiments, the selector comprises a rheostat.

According to embodiments, the motorized suction head further comprises a visual indicator for providing an indication of the speed selected by means of the selector.

According to embodiments, the motorized suction head further comprises a battery for powering the electric motor.

According to embodiments, the on/off switch is operated by the position of a component of the suction head, preferably by the position of a joint of the suction pipe.

According to embodiments, the motorized suction head further comprises a stop system for preventing an excessive increase in the engine load.

According to embodiments, the stop system operates in response to a power consumption value and is configured to stop the operation of the motor when the detected power consumption value is higher than a set value.

The speed selector could be arranged on the vacuum cleaner handle.

The rising power ramp could progress from 0% to 100% over a first time and the falling power ramp could go from 100% to 0% over a second time, and the first time could be substantially the same as the second time.

The first time could be about 0.5 seconds.

BRIEF DESCRIPTION OF THE FIGURES

The present invention will become clearer from the following detailed description, provided purely by way of a non-limiting example, to be read with reference to the accompanying drawings, in which.

DETAILED DESCRIPTION

Figure 1:
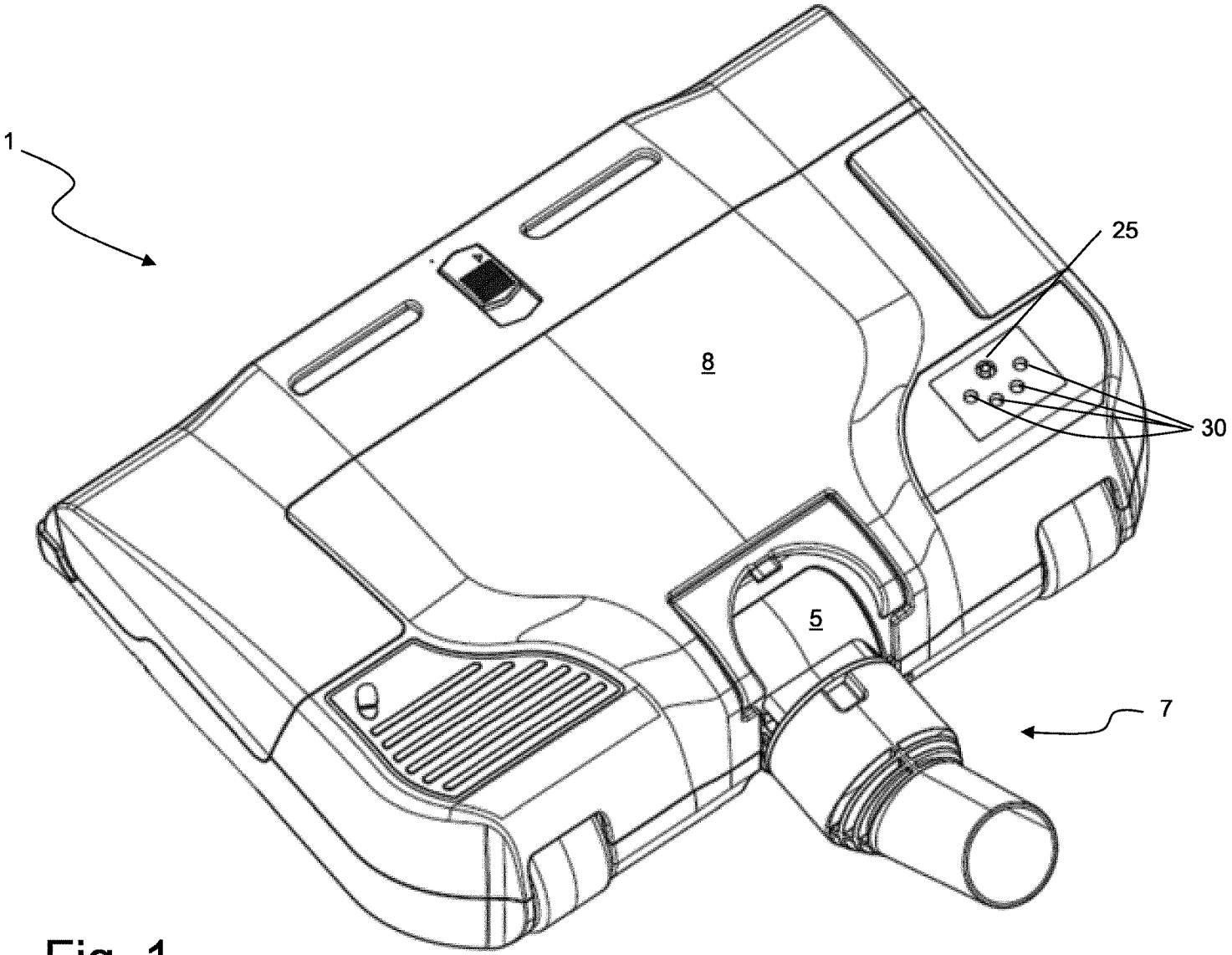
FIG. 1 is a view of a battery-powered motorized brush according to the present invention, in a first configuration.
Figure 2:
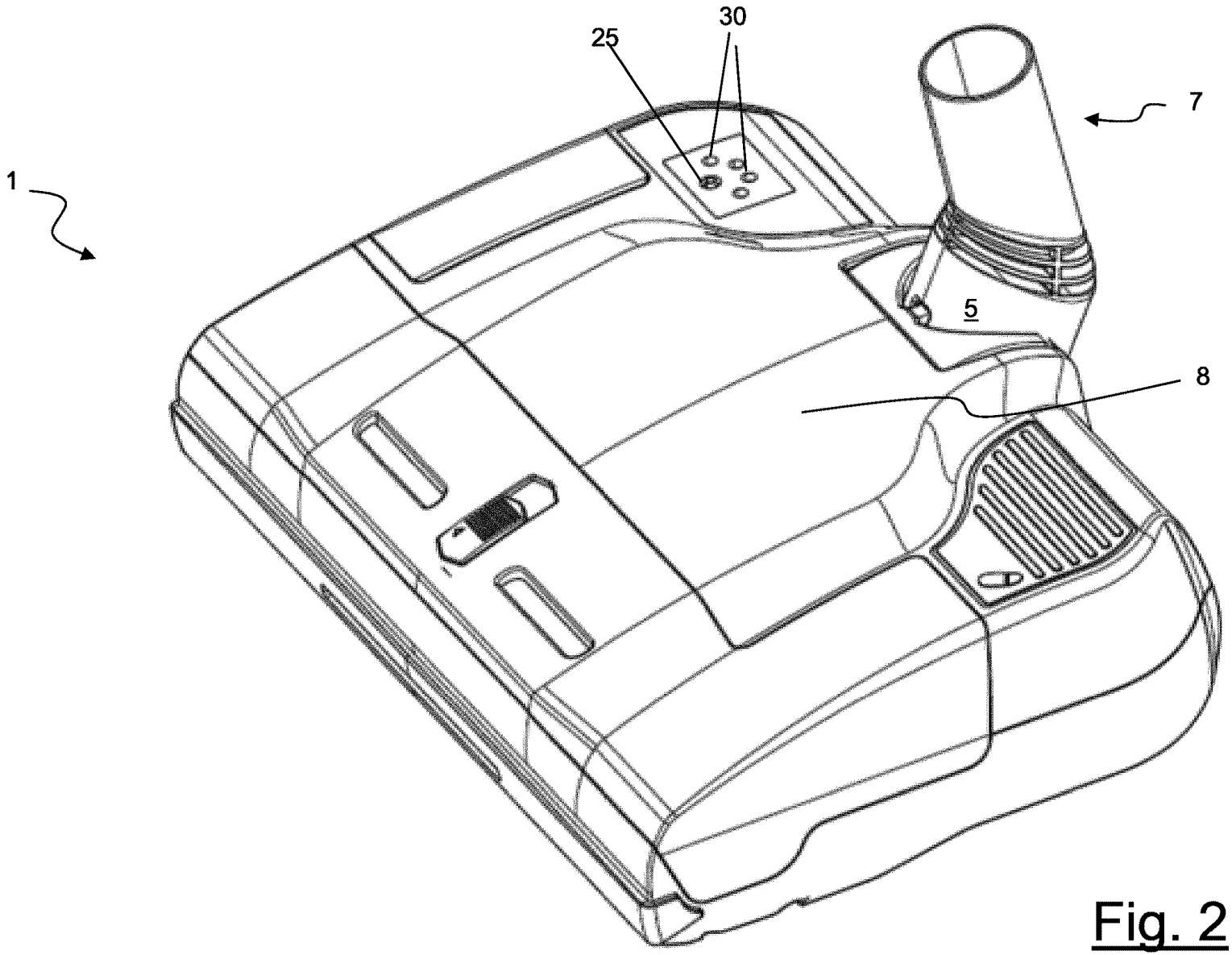
FIG. 2 is a view of the brush shown in FIG. 1, in a second configuration.

With reference initially to FIGS. 1-5, an embodiment of the present invention is described hereinbelow. Obviously, the form of the brush is provided merely by way of example. A brush according to the present invention may have a form different from that shown.

In the various figures, for the sake of clarity, some components not considered essential for the present invention have been omitted. The brush shown in FIGS. 1-5 is a motorized brush which is battery-powered.

With reference to the various FIGS. 1-5, the brush 1 comprises a base plate 2 with at least one base plate channel 3 open downwards, namely towards a surface to be vacuumed. Preferably, it also comprises a curved and suitably shaped suction channel 4 and a rotatable joint 5 rotating about a substantially horizontal axis. The assembly consisting of channel 3, channel 4 and joint 5 forms the suction duct 7.

Figure 3:
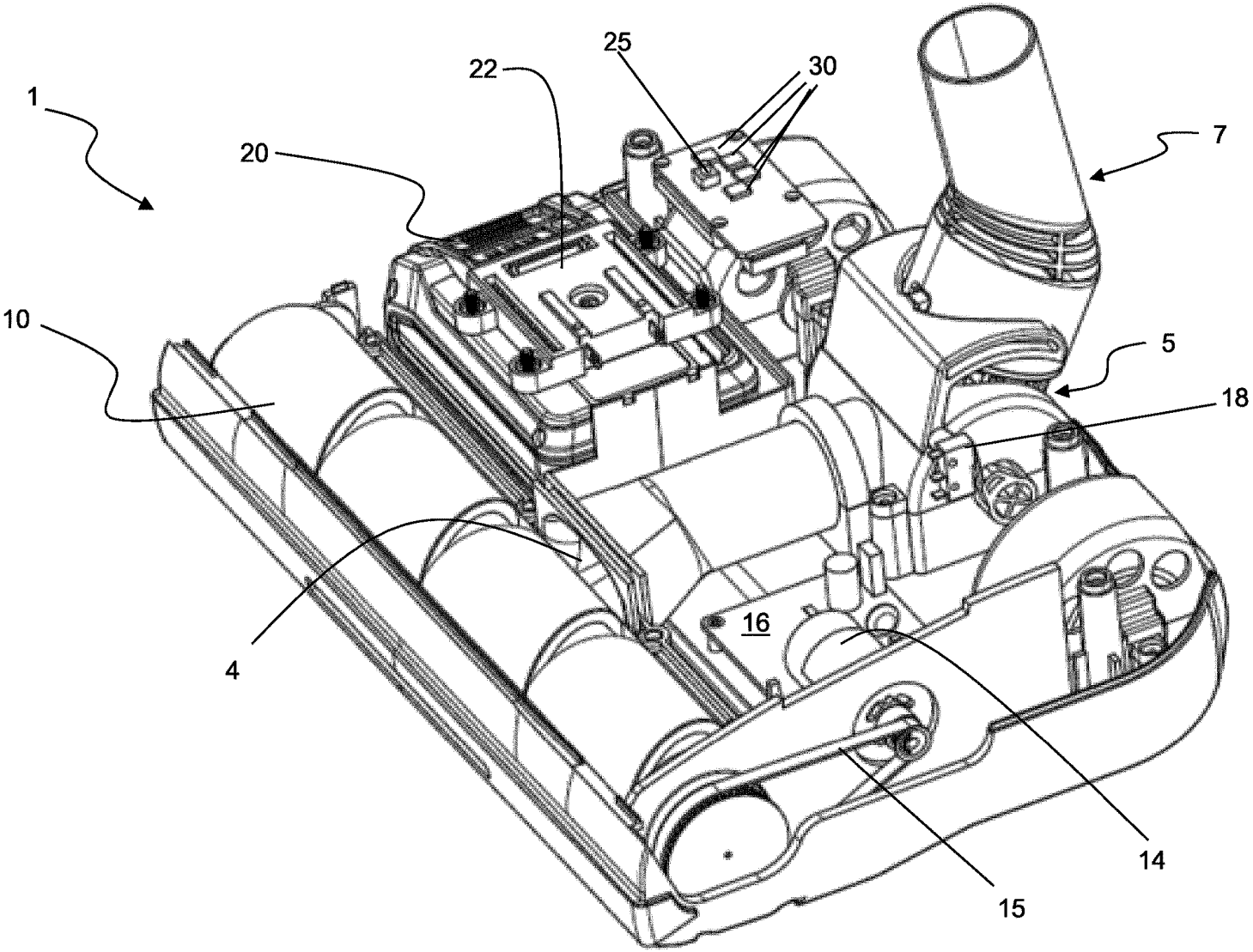
FIG. 3 is a view of the brush shown in FIG. 2, without the brush body, so that some components of the brush may be seen.
Figure 4:
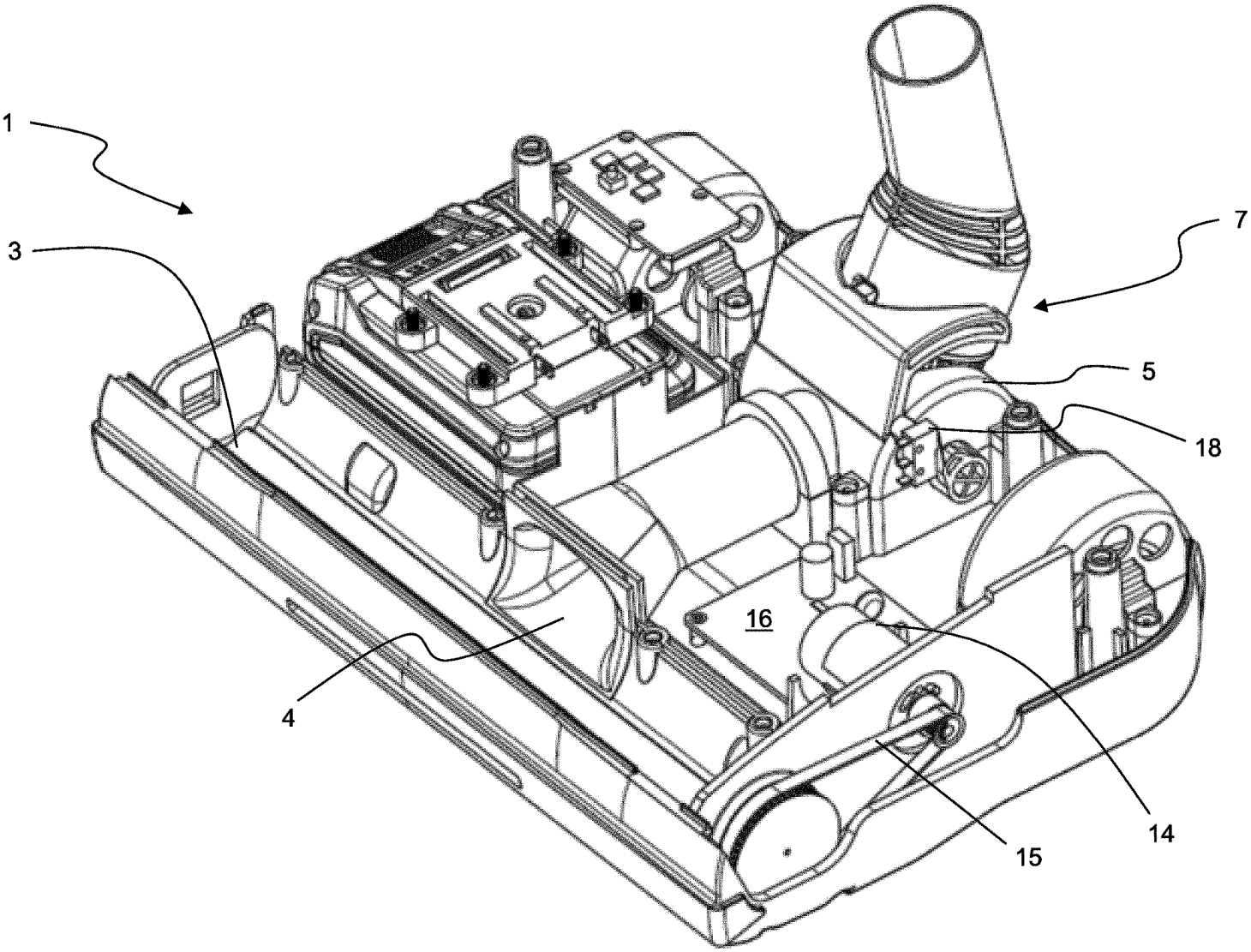
FIG. 4 is a view of the brush shown in FIG. 3, without the roller.
Figure 5:
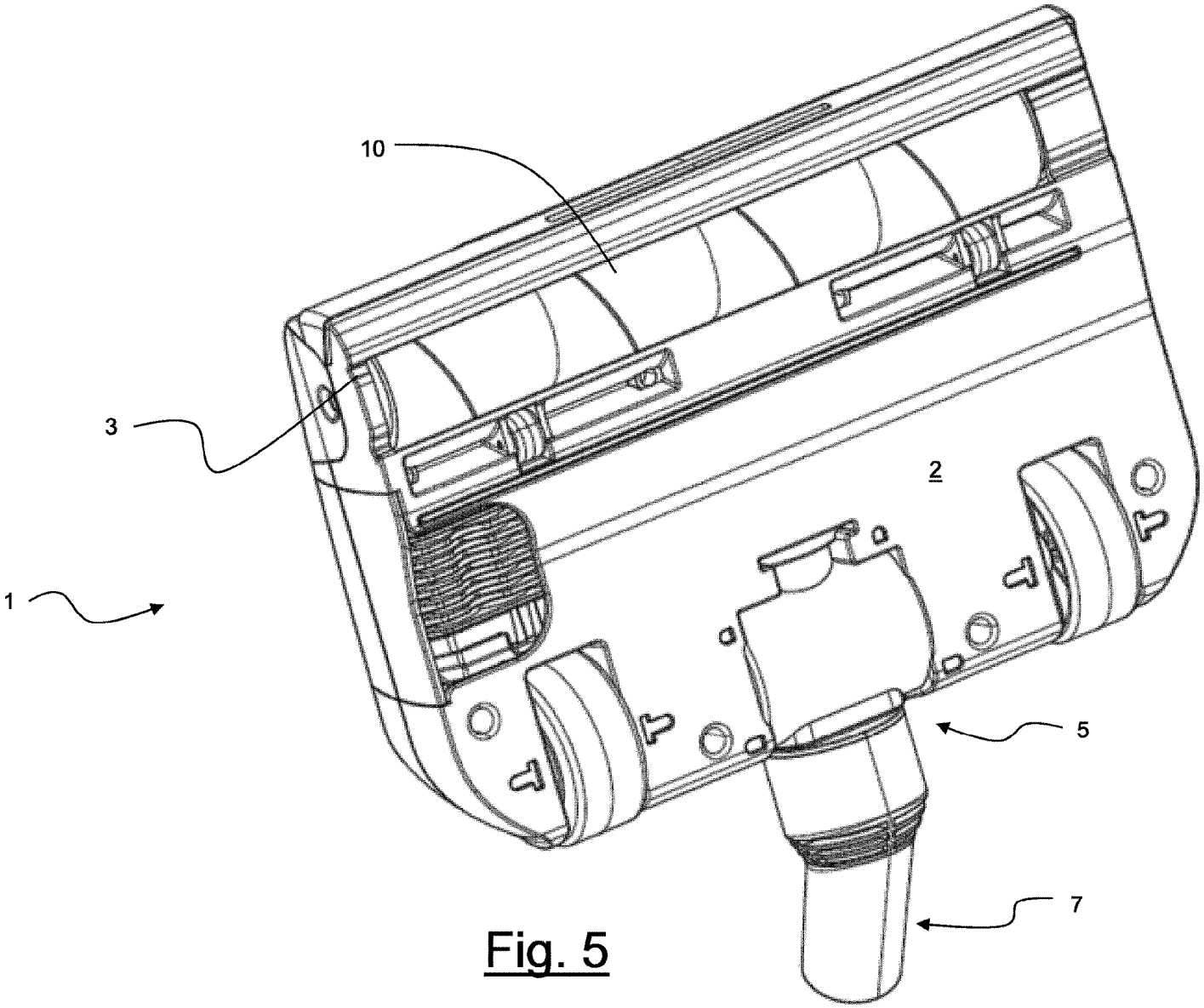
FIG. 5 is a view from below of the brush shown in FIGS. 1-4.
Figure 6:
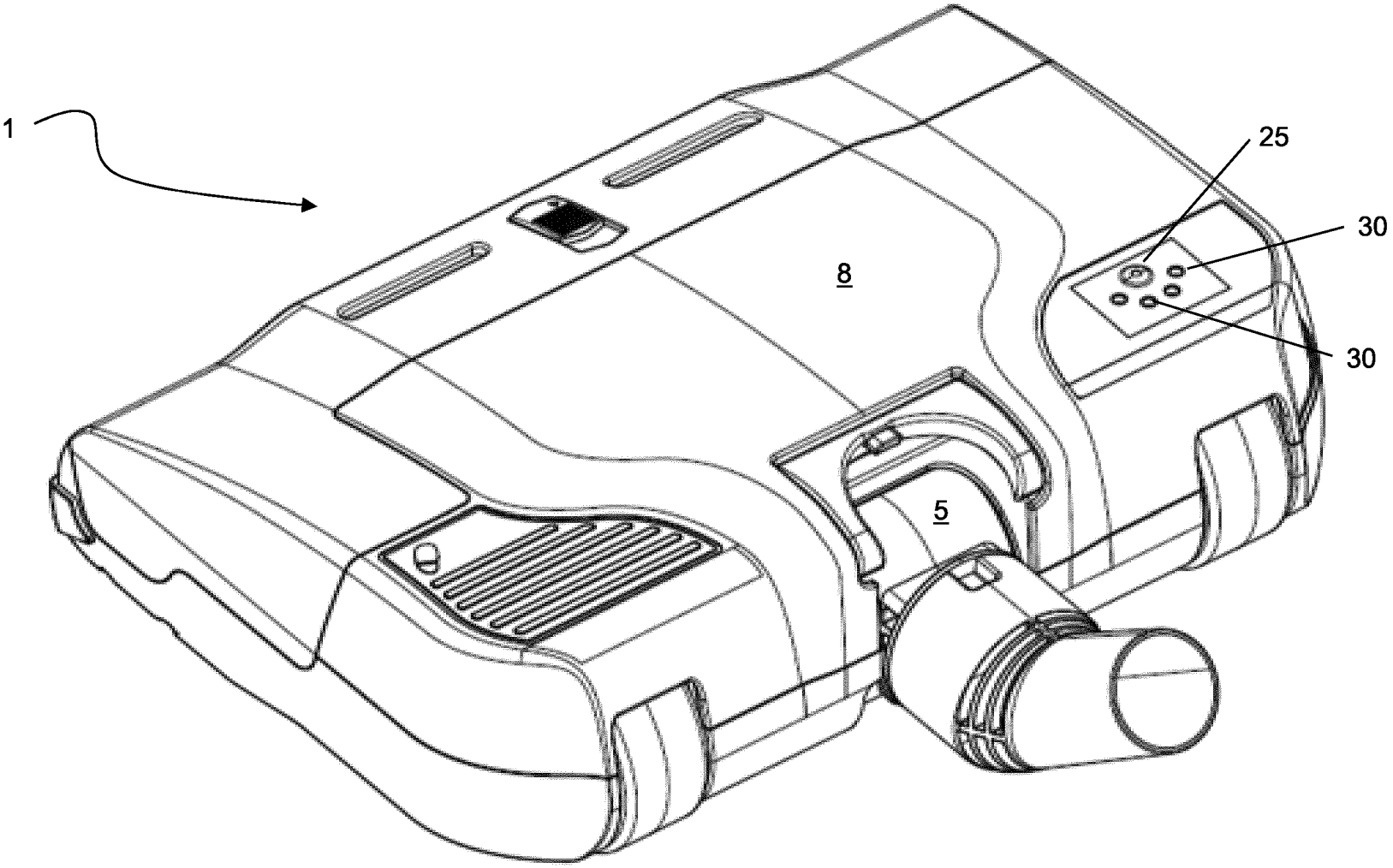
FIG. 6 is a view of an AC powered motorized brush according to the present invention, in a first configuration.
Figure 7:
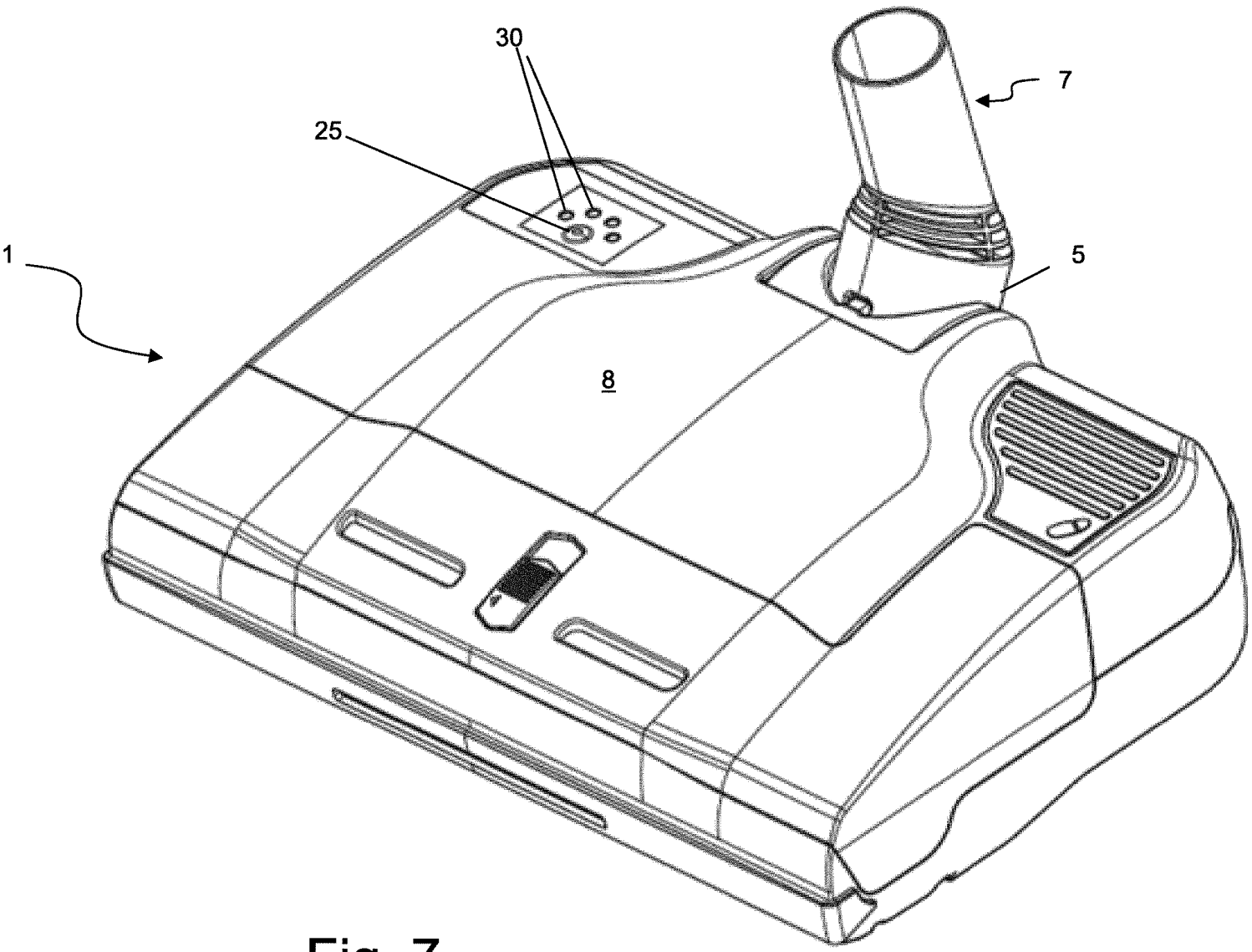
FIG. 7 is a view of the brush shown in FIG. 6, in a second configuration.
Figure 8:
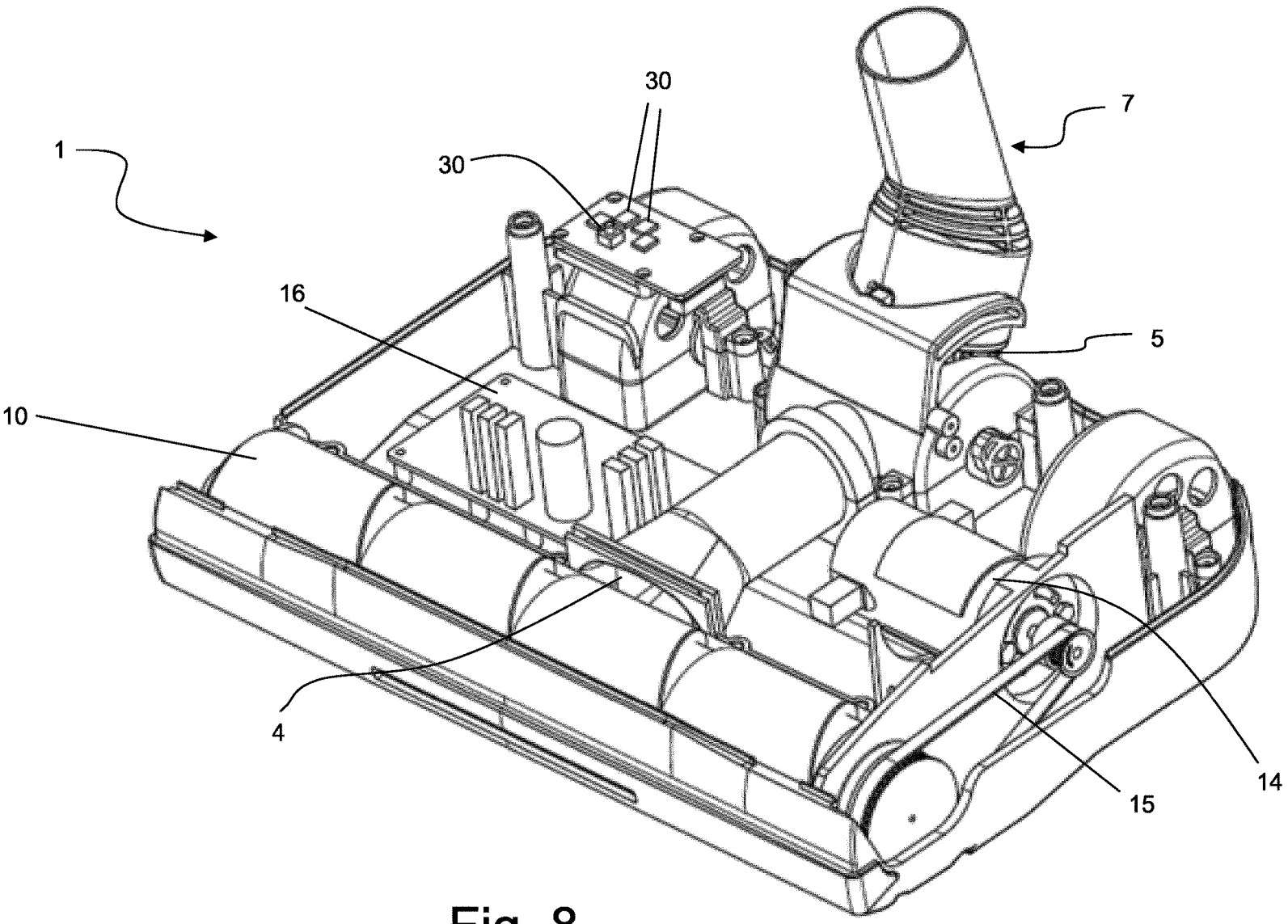
FIG. 8 is a view of the brush shown in FIG. 7, without the brush body so that some components of the brush may be seen.
Figure 9:
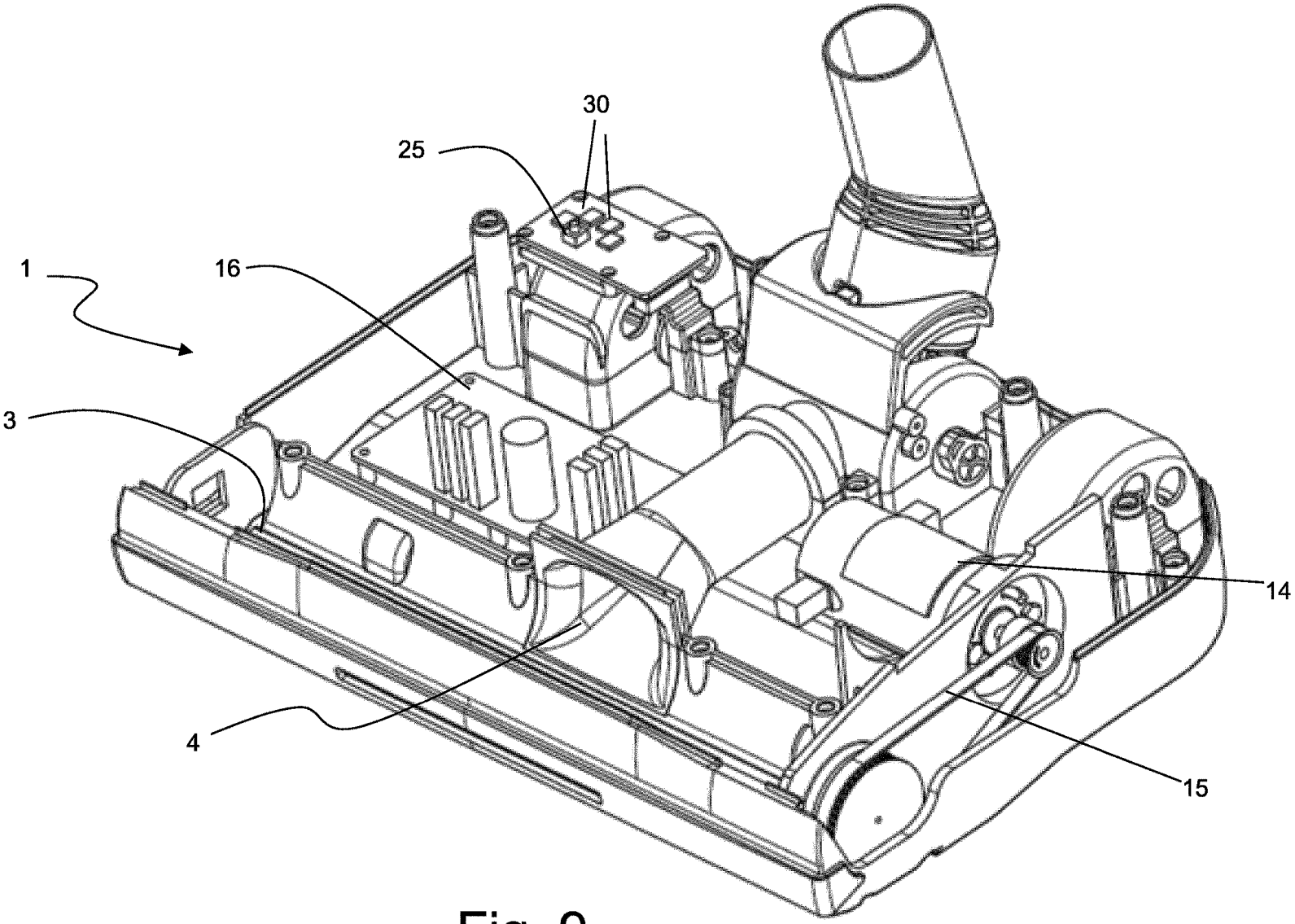
FIG. 9 is a view of the brush shown in FIG. 8, without the roller.
Figure 10:
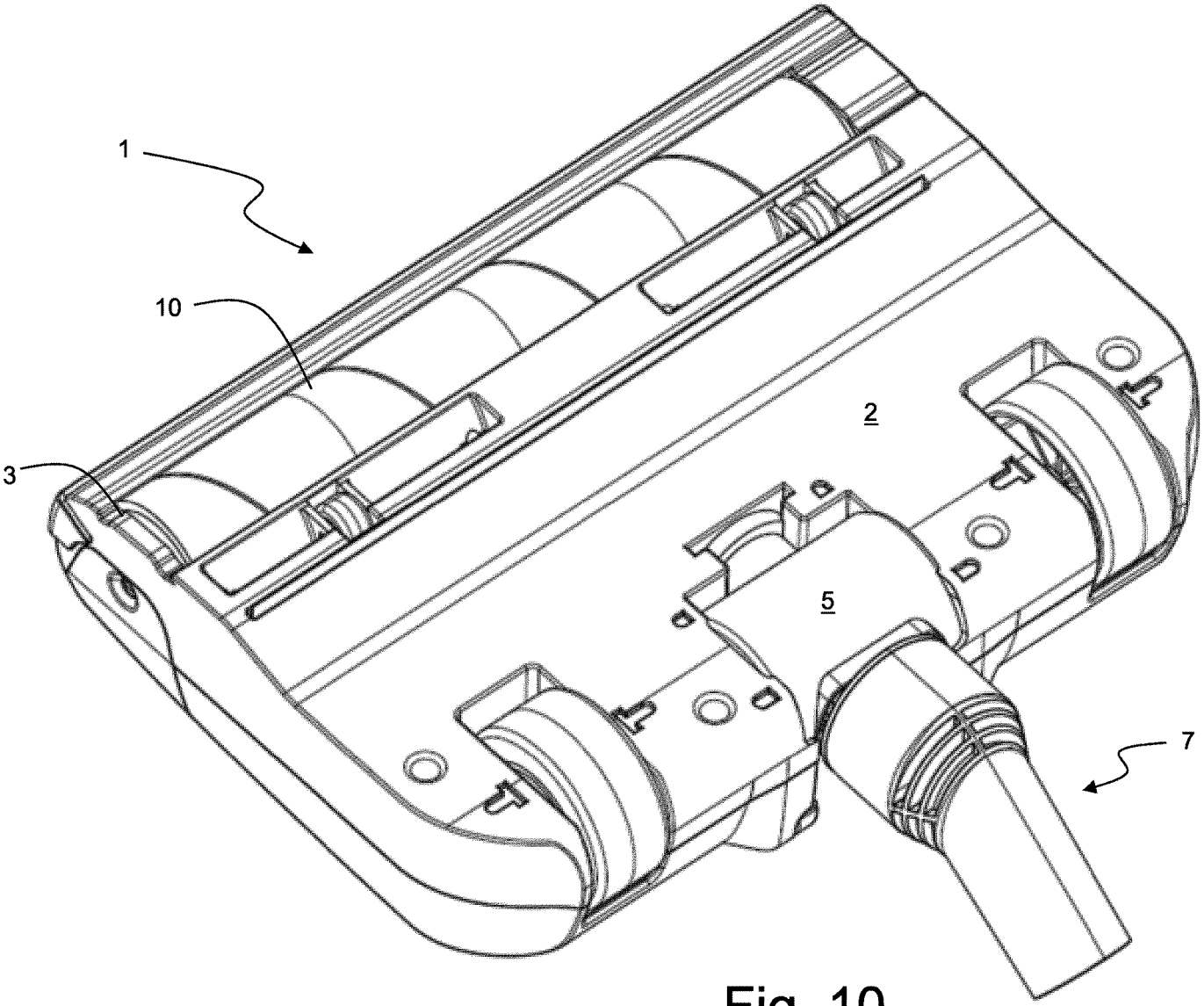
FIG. 10 is a view from below of the brush shown in FIGS. 6-9.

FIG. 3 shows the brush 1 according to the present invention without the brush body 8 so that some components can be seen. The brush 1 has roughly a substantially rectangular form, preferably with rounded corners. A rotatable roller 10 is mounted in the vicinity of the front edge. The rotatable roller 10 has a roughly cylindrical form and its surface may be lined (at least partially) with cleaning elements. For example, the cleaning elements may comprise bristles (which may be suitably arranged in various ways, for example helically, parallel, diverging, converging, etc.), rubber fins (which may also be arranged in various ways as described above for the bristles), velvet strips or other soft material for preventing damage to the surfaces (for example in order to avoid damaging a parquet floor).

The roller 10 is preferably pivotably mounted at it ends. Preferably two coaxial pins are provided. Preferably a first pin is idle and a second pin is motorized. According to the embodiment shown in FIG. 3, the roller 10 is motorized by means of a motor 14 and belt transmission 15. As an alternative to the belt transmission, a chain transmission or gear transmission may be provided. Considering the power levels involved, the working environment and the need to limit vibrations and noise, the belt transmission 15 is considered to be most advantageous.

A board 16 with a printed circuit is associated with the motor 14.

According to the present invention, different motors and power supplies may be provided depending on the use for which the brush 1 is mainly intended. For example one of the following configurations may be envisaged:

1) 16.2 VDC or 18 VDC battery powered motor
2) 120V DC 60 Hz 150 W motor
3) 230V DC 50 Hz-150 W motor
4) 120V DC 60 Hz-250 W motor
5) 230V DC 50 Hz-250 W motor A switch 18, for example a pushbutton switch, is provided for switching the motor 14 on/off. According to one embodiment of the present invention, this switch 18 is operated by the position of the joint 5. When the joint 5 is in the (substantially vertical) configuration shown in FIG. 2, 3 or 4, the motor 14 is switched off. When the joint 5 is in the configuration shown in FIG. 1, corresponding to the operative working position, the motor 14 is switched on. Preferably, the joint 5 has a certain hardness both when it is placed in the vertical position and when it is placed in the working position, so as to avoid accidental switching on/off of the motor 14 which allows rotation of the roller 10.

Advantageously, the motor 14 may be powered by means of a battery 20. The battery 20 may be assembled, equally well, within the brush 1 or outside of the brush.

The battery 20, if it is mounted within the brush 1, it is preferably extractable and able to be recharged outside of the brush 1. According to one embodiment, the battery 20 may be recharged without removing it from the brush 1. According to other embodiments, recharging is not performed if the battery is installed in the brush 1.

By way of example, an 18V 3.0 Ah battery may be used.

According to the embodiment shown in FIG. 3, a special battery support 22 is provided for keeping the battery 20 in position. The removable battery 20, which can be recharged externally, helps lighten the brush 1. Moreover, if the user has another charged battery available, the charged battery may be inserted during recharging of a flat battery so as to ensure continuity of operation.

According to the present invention a selector device 25 is provided for varying the speed V of the motor 14. The speed V may be varied stepwise or continuously. According to one embodiment a single pushbutton (selector 25) with a plurality of positions (namely at least two positions) may be provided so that a different speed corresponds to each position of the pushbutton 25. According to another embodiment, two or more pushbuttons are provided and each of them is configured to set one or more speeds.

According to another embodiment a rheostat controlled by a small wheel or a lever is provided for varying the voltage supply to the electric motor 14 in a more precise manner. Obviously other embodiments known to the person skilled in the art are possible.

According to certain embodiments, for the safety of the operator and to provide protection against objects which could get caught up in the roller 10, a stop system is provided for preventing an increase in the load of the motor beyond a set value.

This situation arises, for example, when an object gets caught up inside the roller and tends to stop rotation thereof. This may be noticed subsequently as an increase in the power consumption of the motor which is usually transformed into a temperature increase and is dissipated in a component, for example in an automatically resetting TCO (thermal cut-off) fuse.

The Applicant has noticed that the use of a thermal fuse results in the stop signal being emitted initially when a given threshold is exceeded. Resetting is performed when the temperature falls below a value which is usually slightly lower than the activation value. At this point only a small temperature increase and hence increase in load is sufficient for the motor stop to be activated again. It is therefore required to wait for a certain period of time in order to allow cooling to a value which diverges substantially from the threshold value.

According to the present invention reading of the power consumption is performed in order to interrupt operation of the motor not by a "thermal" component, but using software provided in the electronic board processor and therefore based on an evaluation of the real power consumption. Reactivation allows the brush to be used without having a kind of "memory effect" as in the case of the thermal fuse.

According to one embodiment, there are four selectable speeds. The speed is selected by operating a single pushbutton 25 which is positioned on the cover of the brush 1, on the top right-hand side (viewed from the operator's position). The pushbutton 25 can be activated manually and allows switching from the speed V1 to the speed V2, V3 and then V4. Pushing further the pushbutton 25 causes the speed to drop to the speed V3, to V2 and then to V1.

When the motor 14 is activated the starting speed is V1.

The variation in speed V of the motor 14 is performed by adjusting the power supply voltage.

The advantage of being able to vary the speed is exploited in order to adapt operation depending on the surface which is to be cleaned and/or other factors (for example in order to increase the duration of operation of the roller).

The rotation speed V of the roller 10, for the same surface, influences the suction efficiency, so that it is reduced when the speed decreases.

In the case of a battery supply system a reduction in the speed results in an increase in the operational autonomy.

Tests were carried out using a battery-powered motor (16.2 VDC motor, Manufacturer No. 1) in order to assess the variations in suction efficiency on a carpet and the difference in autonomy when the speed is varied. The results obtained are summarised in Table 1 below.

TABLE 1

| | Voltage | Suction efficiency | Autonomy [min.] |
|---|---|---|---|
| V4 | 100% | 92% | 45 |
| V3 | 80% | 90% | 55 |
| V2 | 50% | 80% | 120 |
| V1 | 30% | 66% | 200 |

As regards the variation in suction efficiency, it may be regarded as being the same, in terms of percentage variation, for hard surfaces (hard floors) and for mains-powered motors.

It can be noted that, when the voltage is 100%, the autonomy is 45 minutes. The autonomy does not change significantly when the voltage is at 80% (speed V3): it changes in fact from 45 minutes to 55 minutes. If the speed V4 is changed to the speed V3 a few minutes before the battery loses all its power, the working time is increased slightly. A very significant advantage is instead obtained when the speed is changed to V2 to V1. Compared to an autonomy of 45 minutes at the maximum speed V4, an autonomy of 120 minutes is reached at the speed V2 and 200 minutes at the minimum speed. The user may therefore set the speed depending on the surface to be cleaned, its condition and also the time needed to clean the whole surface. For example, if a working time of 60 minutes is needed to clean the whole surface, the maximum speed V2 may be set manually, but the speed V4 (or V3) may also be set for a first time period and the speed V2 (or V1) set for a second time period. The user, in this case, preferably will start from the zone which requires most power and in that zone will set the higher speed V4 (or V3).

The user may then gradually adjust the power depending on the surface and its condition, but also its area (and therefore the time needed to clean all of it). In addition to the obvious practical advantages, there is also an undeniable advantage of energy savings and therefore reduced environmental impact.

Assessed in terms of percentage variations, the following values are obtained (both the reduction in suction efficiency and the increase in autonomy are in relation to the previous speed):

TABLE 2

| | Voltage | % decrease in suction efficiency compared to the previous speed | % increase in autonomy [min.] compared to the previous speed |
|---|---|---|---|
| V4 | 100% | | |
| V3 | 80% | −2% | +22% |
| V2 | 50% | −11% | +120% |
| V1 | 30% | −17% | +67% |

The percentage increase in autonomy for the speed V2 and V1 is significant compared to a relatively small variation in suction efficiency.

The position of the speed variator may be different from that shown in the figures. According to particularly advantageous embodiments, the speed adjustment device may also be placed on the vacuum cleaner handle.

According to advantageous embodiments, a corresponding visual indicator 30 is provided for each selected speed. For example, a first LED may be provided for the speed V1, a second LED may be provided for the speed V2, and so on. A single visual indicator may also be provided, said indicator assuming different colour tones depending on the speed selected.

According to embodiments, a display (or other device) 32 with an indication of the battery charging level is provided for indicating to the user the current charging level so that the user may (if he/she so wishes) adapt the speed to the remaining battery charge.

As mentioned above, preferably the rotation of the rotating roller 10 is performed by means of a switch. The switch may be associated with the joint or may be separate from it.

According to embodiments, in order to avoid a power surge at start-up, starting is performed with an acceleration ramp progressing from 0 to 100% over a time which may be for example 0.5 seconds.

According to embodiments, a similar (or the same) deceleration ramp is envisaged for switch off.

Should objects get caught up in the roller, there will be a consequent increase in the power consumption of the motor. According to embodiments, when this consumption exceeds by a certain percentage amount (for example 50%, 60% or 70%) the maximum power consumption of the motor, the motor is switched off. Advantageously a system which essentially does not involve reactivation delays may be used since a "thermal" safety system is not used, so that reactivation may be immediate, without having to wait for the thermal switch to be reset and without modifying the operating threshold which in a "thermal" system is set as to be increasingly different.

In order to switch on the motor again it is required to simply adjust the position of the joint, moving it into the "off" position and then back into the "on" position.

According to embodiments, the operational parameters under maximum power conditions are as follows:

1) 16.2 VDC motor (Manufacturer No. 1): Power consumption approx. 12 A
2) 18 VDC motor (Manufacturer No. 2): Power consumption approx. 10 A
3) 120V DC 60 Hz-150 W motor (Manufacturer No. 1): Power consumption approx. 3.5 A
4) 230V DC 50 Hz-150 W motor (Manufacturer No. 1): Power consumption approx. 0.75 A
5) 120V DC 60 Hz-250 W motor (Manufacturer No. 1): Power consumption approx. 4.8 A
6) 230V DC 50 Hz-250 W motor (Manufacturer No. 1): Power consumption approx. 3.3 A Initially, the motor stop value for an emergency may be set, for example, to 40% less than the values indicated above. Preferably, the value is set during calibration of the board and cannot be modified by the user.

Depending on whether operation is on a hard floor (HF) or a carpet, different rotation speeds of the roller may be used.

From the tests carried out it seems that the speed on a HF must be about 60% of the maximum speed which is instead used on carpets.

The variation in this speed is achieved using the aforementioned selector which allows operation at 100% or 60% of the motor speed.

An additional option is that of having two "high" speeds (100% and 80%) and two low speeds (50% and 35%) in order to manage more efficiently the different surfaces to be cleaned. In this case also the choice will be made using a selector.

FIGS. 6-10 show a brush according to a second embodiment of the present invention. The second embodiment differs from the first embodiment in that the motor is not powered with a DC power supply from a battery. In the second embodiment, the motor 14 is instead powered by means of AC power supply.

If there is no battery and the motor 14 has preferably dimensions greater than the battery-powered motor 14, advantageously the board 16 may be housed in a different position, for example in the first area reserved for the battery.

As regards the rest, the second embodiment has all the main characteristics of the first embodiment. Externally, preferably there is no closing flap for providing for access to the battery compartment.

The invention claimed is:

1. A motorized suction head comprising a roller, the roller being rotatable and being configured to rub the surface to be cleaned, an electric motor and a transmission for connecting the roller to the electric motor so as to rotate the roller, an on/off switch for starting and stopping the rotation of the motor, wherein the suction head further comprises a speed selector for selecting one of a plurality of rotation speeds of the electric motor, wherein the suction head further comprises an electronic board programmed to provide a rising ramp when the electric motor is turned on and/or a falling ramp when the electric motor is turned off.

2. The motorized suction head according to claim 1, wherein the speed selector is a manual selector.

3. The motorized suction head according to claim 1, wherein the speed selector comprises a pushbutton.

4. The motorized suction head according to claim 1, wherein the speed selector comprises a rheostat.

5. The motorized suction head according to claim 1, further comprising a visual indicator for providing an indication of the speed selected by means of the selector.

6. The motorized suction head according to claim 1, further comprising a battery for powering the electric motor.

7. The motorized suction head according to claim 1, wherein the on/off switch is operated by the position of a component of the suction head.

8. The motorized suction head according to claim 7, wherein the on/off switch is operated by the position of a joint of the suction pipe.

9. The motorized suction head according to claim 1, further comprising a stop system for preventing an excessive increase in the motor load.

10. The motorized suction head according to claim 9, wherein the stop system operates in response to a power consumption value and is configured to stop the operation of the motor when the detected power consumption value is higher than a set value.

11. The motorized suction head according to claim 1, wherein the speed selector is arranged on the vacuum cleaner handle.

12. The motorized suction head according to claim 1, wherein the rising ramp progresses from 0% to 100% over a first time and the falling ramp goes from 100% to 0% over a second time, wherein the first time is substantially the same as the second time.

13. The motorized suction head according to claim 12, wherein the first time is about 0.5 seconds.

* * * * *